US006286353B1

(12) United States Patent
Brück

(10) Patent No.: US 6,286,353 B1
(45) Date of Patent: Sep. 11, 2001

(54) PROCESS FOR PRODUCING AT LEAST ONE STRUCTURED METAL SHEET, PROCESS FOR PRODUCING A LAMINATED METAL SHEET PACK AND APPARATUS FOR PRODUCING STRUCTURED METAL SHEETS

(75) Inventor: Rolf Brück, Bergisch Gladbach (DE)

(73) Assignee: EMITEC Gesellschaft fuer Emissionstechnologie mbH, Lohmar (DE)

( * ) Notice: Subject to any disclaimer, the term of this patent is extended or adjusted under 35 U.S.C. 154(b) by 0 days.

(21) Appl. No.: 09/302,654

(22) Filed: Apr. 30, 1999

Related U.S. Application Data

(63) Continuation of application No. PCT/EP97/05097, filed on Sep. 17, 1997.

(30) Foreign Application Priority Data

Oct. 30, 1996 (DE) ..... 196 43 934

(51) Int. Cl.[7] ..... B21D 13/04
(52) U.S. Cl. ..... 72/187; 72/379.6
(58) Field of Search ..... 72/187, 379.6

(56) References Cited

U.S. PATENT DOCUMENTS 2,866,075 * 12/1958 Van Pappelendam ..... 72/187
2,975,817 * 3/1961 Neff ..... 72/187
3,481,173 * 12/1969 Rhodes ..... 72/187
5,819,575 * 10/1998 Kobayashi et al. ..... 72/379.6

FOREIGN PATENT DOCUMENTS 42 41 469 A1 6/1994 (DE) .
0 201 614 A1 11/1986 (EP) .
0 210 546 A1 2/1987 (EP) .
0 245 737 B1 11/1987 (EP) .
0 279 159 A1 8/1988 (EP) .
0 460 611 A1 12/1991 (EP) .
1535781 * 12/1978 (GB) ..... 72/187
64-66022 * 3/1989 (JP) ..... 72/186

* cited by examiner

*Primary Examiner*—Lowell A. Larson
(74) *Attorney, Agent, or Firm*—Herbert L. Lerner; Laurence A. Greenberg; Werner H. Stemer

(57) ABSTRACT

A process for producing at least one structured metal sheet, a process for producing a laminated metal sheet pack and an apparatus for producing structured metal sheets, include initially subjecting a strip of sheet metal to a structuring operation to form a structure having a structural height which is greater than a theoretical or desired structural height. The structuring operation is followed by a calibration operation in a calibration unit. The structure is guided through two rollers of the calibration unit in such a way that the height of the structure once it has passed through the calibration unit corresponds to the theoretical or desired structural height.

17 Claims, 1 Drawing Sheet

PROCESS FOR PRODUCING AT LEAST ONE STRUCTURED METAL SHEET, PROCESS FOR PRODUCING A LAMINATED METAL SHEET PACK AND APPARATUS FOR PRODUCING STRUCTURED METAL SHEETS

CROSS-REFERENCE TO RELATED APPLICATION

This application is a continuation of copending International Application No. PCT/EP97/05097, filed Sep. 17, 1997, which designated the United States.

BACKGROUND OF THE INVENTION

Field of the Invention

The invention relates to a process for producing at least one structured metal sheet, a process for producing a laminated metal sheet pack and an apparatus for producing structured metal sheets. Such metal sheets are processed primarily to constitute honeycomb bodies for catalytic converters which are used in particular in motor vehicle exhaust gas systems. Such a honeycomb body is described, for example, in European Patent 0 245 737 B1.

Structured metal sheets are generally produced in the state of the art by shaped rollers which mesh with each other and which preferably have an involute tooth configuration or a tooth configuration of a similar construction. However, other geometries for the structures, for example a trapezium shape, a zig-zag shape, etc., are also known.

Portions are cut off the structured strip-shaped metal sheet and stacked to form a metal sheet pack, with a smooth sheet being inserted between the structured metal sheets. The ends of the stack are, for example, twisted in mutually opposite directions around at least two fixed points. The stack when deformed in that way is fitted into a tubular casing. The tubular casing, with the metal sheet stack fitted therein, is then subjected to a brazing operation in which the tubular casing with the metal sheet stack and the individual sheets are brazed together. The tubular casing and the metal sheet stack have different coefficients of thermal expansion. In order to ensure that a satisfactory brazed connection is produced between the metal sheets in relation to each other, and between the metal sheets and the tubular casing, it has already been proposed that the metal sheet pack be fitted into the tubular casing in a prestressed condition so that no gap formation occurs between the metal sheets and/or between the metal sheets and the tubular casing. In the case of honeycomb bodies which are wound in a spiral shape, it has already been proposed that radial depressions should be provided in the structured metal sheet at apex regions of the structure. The material serving for the welding or brazing operation can be disposed in the depressions.

The strip-shaped metal sheet experiences deformation during the structure-forming step. There are fluctuations in the height of the structure of the structured metal sheet due to fluctuations in the material properties of the metal sheet. Those fluctuations in the height of the structure are due to the fact that the elasticity of the metal sheet lies within a tolerance band. Tolerances with respect to the shaped rollers may possibly also be superimposed on that effect, so that there is no guarantee that metal sheet packs can always be fitted into a tube under the same prestressing. It has also been found that the cell density of a honeycomb body may also be different, with the same production process.

European Patent Application 0 279 159 A1, corresponding to U.S. Pat. No. 4,845,073, discloses a process for producing at least one structured metal sheet, wherein the structure is formed by inter-engaging toothed rollers.

European Patent Application 0 490 611 A1 also discloses a process and an apparatus for producing welded laminated metal sheets and packs of metal sheets.

European Patent Application 0 460 611 A1 discloses a structure-providing step through the use of which a first metal sheet is provided with a structure by using shaped rollers. A second, smooth metal sheet, is then applied to the structured sheet and the first and second metal sheets are passed through a second pair of rollers.

SUMMARY OF THE INVENTION

It is accordingly an object of the invention to provide a process for producing at least one structured metal sheet, a process for producing a laminated metal sheet pack and an apparatus for producing structured metal sheets, which overcome the hereinafore-mentioned disadvantages of the heretofore-known processes and apparatuses of this general type and which ensure that, upon further processing of the structured metal sheets, or the metal sheet pack to constitute a honeycomb body, fluctuations in prestressing with which a metal sheet pack can be fitted into a tubular casing are slight. A further aim of the invention is to ensure that a honeycomb body which is formed by structured metal sheets has a constant cell density.

With the foregoing and other objects in view there is provided, in accordance with the invention, a process for producing at least one structured metal sheet, which comprises initially subjecting a strip-shaped metal sheet to a structure-forming step, forming a structure with a structure height greater than a desired structure height; and thereafter subjecting the metal sheet to a calibration step by applying a force to the structure of the metal sheet, causing the height of the structure to correspond to the desired structure height after the calibration step.

The fact that, during the structure-forming step, the height of the structure is greater than a desired or reference height ensures that the height of the structure of the metal sheet is sufficiently great, in spite of a spring-back effect. In addition any tolerances in shaped tools are compensated. The calibration step involves applying a force to the apex regions of the structure by which the structure is deformed so that after the calibration step the height of the structure corresponds to the reference height.

In accordance with another mode of the invention, during the structure-forming step the metal sheet is passed between two inter-engaging shaped tools, preferably between two meshing shaped tools.

In accordance with a further mode of the invention, the overall shaped height of the shaped tools, in particular the shaped rollers, is preferably greater than the desired structure height. If the shaped tools are formed as shaped rollers, the shaped rollers may be rollers with an involute profile, for example.

In accordance with an added mode of the invention, the calibration step preferably takes place in such a way that the metal sheet with the structure is passed through a gap having a gap height which is smaller than the desired structure height of the metal sheet or corresponds to the desired structure height of the metal sheet. In accordance with an additional mode of the invention, a gap of this kind can preferably be formed by configuring two rollers with their axes disposed in parallel relationship.

In accordance with yet another mode of the invention, in order to ensure that a honeycomb body which is produced from a structured metal sheet or a pack of metal sheets has a constant cell density, after the calibration step the spring property of the structure of the metal sheet is determined. A blank length is ascertained in consideration of the spring property, and a portion is cut off the strip-shaped metal sheet corresponding to the blank length. A structured metal sheet which is produced in this way allows a honeycomb body to be produced which has a reproducible cell density, and the metal sheets can be used in a tubular casing with reproducible prestressing.

In accordance with yet a further mode of the invention, the blank length which is ascertained is used as a measurement for further portions.

In accordance with another concept according to the invention, there is proposed a process for producing a laminated metal sheet pack, as is known, for example, from European Patent 0 45 737 B1.

Accordingly, with the objects of the invention in view, there is also provided a process for producing a laminated metal sheet pack, which comprises initially subjecting a first strip-shaped metal sheet to a structure-forming step, forming a structure in the first metal sheet having a structure height greater than a desired structure height; thereafter subjecting the structure to a calibration step by applying a force to the structure of the first metal sheet, causing the height of the structure to correspond to the desired structure height after the calibration step; and placing a second strip-shaped metal sheet, preferably a smooth metal sheet, onto the first metal sheet.

In accordance with another mode of the invention, during the structure-forming step, the first strip-shaped metal sheet is passed through between two inter-engaging shaped rollers, preferably between two meshing shaped rollers.

In accordance with a further mode of the invention, the remainder of the metal sheet is passed between shaped tools, in particular shaped rollers, the overall shaped height of which is greater than the desired structure height.

In accordance with an added mode of the invention, the second strip-shaped metal sheet is laid on the first strip-shaped metal sheet after the calibration step. Alternatively, it is proposed that the second metal sheet is laid onto the first metal sheet prior to the calibration step. That operation provides for the structured metal sheet to be calibrated jointly with the second, preferably smooth metal sheet.

In accordance with an additional mode of the invention, after the calibration step, the spring property of the structure of the first metal sheet or the spring property of the laminated metal sheets is ascertained and, with regard to the spring property, a blank length is ascertained and the first metal sheet or the laminated metal sheets are cut off, in accordance with the blank length.

With the objects of the invention in view, there is additionally provided an apparatus for producing structured metal sheets and/or packs of metal sheets, comprising a structure-imparting unit having at least two inter-engaging shaped tools for forming a structure with a structure height in a metal sheet moving in a given transport direction, the shaped tools having an overall shaped profile height greater than a predetermined desired structure height; and a calibration unit disposed downstream of the structure-imparting unit in the given transport direction, for applying a force to the structure of the metal sheet causing the height of the structure downstream of the calibration unit to correspond to the desired structure height.

In accordance with another feature of the invention, the structure-imparting unit has at least two meshing shaped rollers which preferably have an involute profile. The use of rotatable shaped rollers permits a continuous production operation for a structured metal sheet. Alternatively, for the sequential production of a structure in a metal sheet, it is possible to use a structure-imparting unit including two shaped tools which are movable towards each other and between which the metal sheet is deformable.

In accordance with a further feature of the invention, the calibration unit has at least two calibration tools, between which the metal sheet can be brought, and the calibration tools define a gap having a height which is less than the shaped height of the shaped tools. The gap height preferably corresponds to the desired or reference height of the structure that a structured metal sheet is to have.

In accordance with an added feature of the invention, the gap height is preferably adjustable by displacement of the calibration tools.

In accordance with an additional feature of the invention, the calibration tools are preferably formed by two rollers which are disposed with their axes in substantially parallel relationship. The rollers are preferably disposed in such a way that the axes of the rollers extend substantially transversely to the direction of transportation movement of a metal sheet.

In accordance with a concomitant feature of the invention, disposed downstream of the calibration unit are a measuring unit by which the spring property of the metal sheet is ascertained, and a severing unit by which the metal sheet is cut to length, in accordance with the spring property.

Other features which are considered as characteristic for the invention are set forth in the appended claims.

Although the invention is illustrated and described herein as embodied in a process for producing at least one structured metal sheet, a process for producing a laminated metal sheet pack and an apparatus for producing structured metal sheets, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
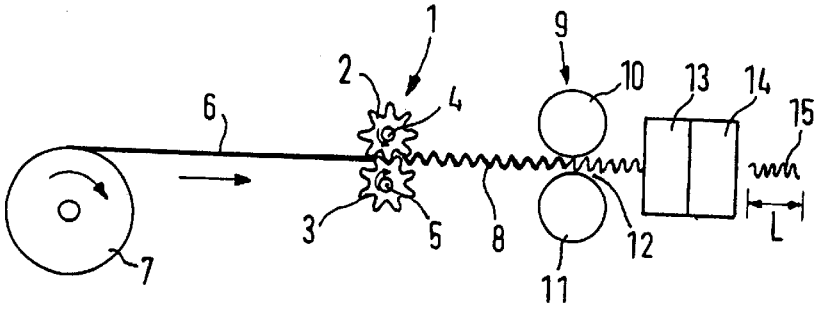
FIG. 1 is a diagrammatic, side-elevational view of a first embodiment of an apparatus for producing structured metal sheets.

Referring now to the figures of the drawings in detail and first, particularly, to FIG. 1 thereof, there is seen a diagrammatic illustration of an apparatus for producing structured sheets. The apparatus has a structure-imparting unit 1. The structure-imparting unit 1 includes two meshing shaped rollers 2, 3. The shaped rollers 2, 3 have an involute shape in profile, for example. Axes 4, 5 of the shaped rollers 2, 3 extend in mutually parallel relationship. A strip-shaped metal sheet 6 which is unwound from a coil 7 runs between the shaped rollers 2, 3. A structure 8 is imparted to the metal sheet 6 while it is passing through the structure-imparting unit 1. The structure 8 substantially corresponds to the profile shape of the shaped rollers 2, 3. A calibration unit 9 is disposed downstream of the structure-imparting unit 1, as considered in the direction of transportation movement of the metal sheet 6. The calibration unit 9 has two calibration tools which are in the form of two rollers 10, 11. The rollers 10, 11 are disposed with their axes in parallel relationship. Peripheral surfaces of the rollers 10, 11 define a gap 12 through which the structured metal sheet 6 is passed. A measuring unit 13 and a severing unit 14 are disposed downstream of the calibration unit 9.

The measuring unit 13 determines a spring property of the structure 8 of the metal sheet 6. Considering the spring property of the structure 6, a blank length L is ascertained, and a portion 15 corresponding to the blank length L is cut off the strip-shaped metal sheet 6, in the severing unit 14. The operation of ascertaining the spring property of the structure 8 of the metal sheet 6 can be effected by a force/travel measurement procedure.

Figure 2:
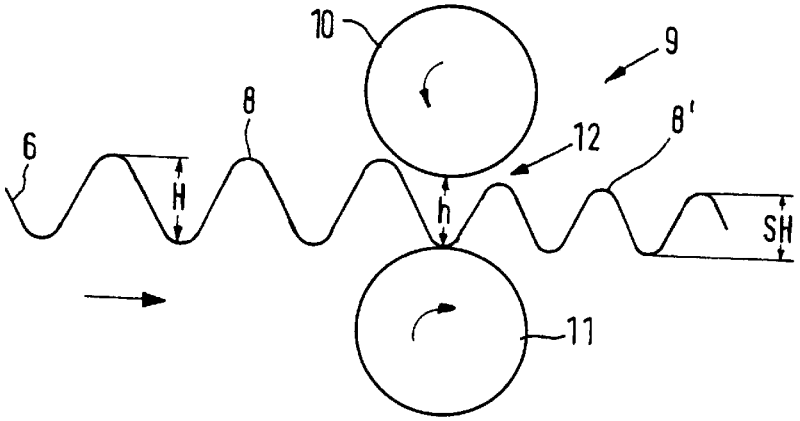
FIG. 2 is an enlarged, side-elevational view of a calibration unit.

FIG. 2 shows an example of the structure 8 imparted to the metal sheet 6. The profile shape of the shaped rollers 2, 3 is provided in such a way that a height H of the structure 8 is greater than a predetermined desired or reference structure height SH. The metal sheet when structured in such a way is passed through the gap 12 between the rollers 10, 11. A height h of the gap 12 is selected in such a way that the structure 8 is compressed when the metal sheet 6 passes through between the rollers 10, 11. A structure 8' downstream of the calibration unit 9 therefore has a height which corresponds to the desired structure height SH. The rollers 10, 11 are mounted rotatably. The gap height h is preferably adjustable through the use of the displaceable rollers 10, 11.

Reference will now be made to the apparatus shown in FIG. 3.

Figure 3:
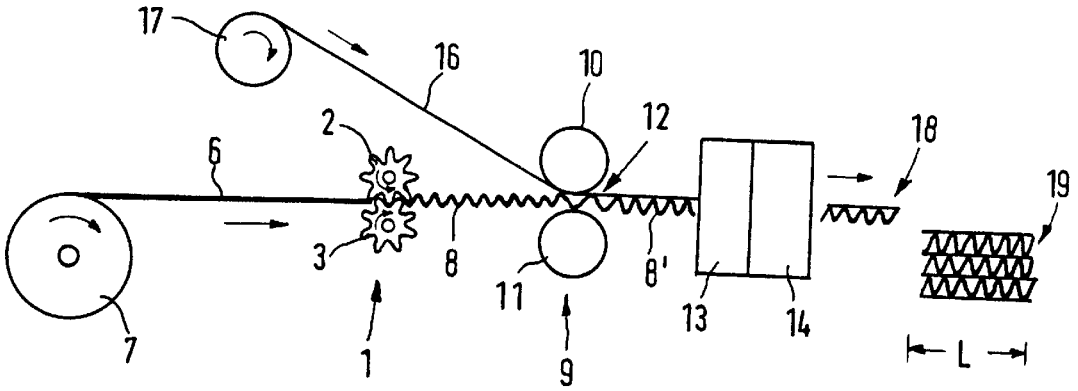
FIG. 3 is a side-elevational view of a second embodiment of an apparatus for producing structured sheets.

The apparatus illustrated in FIG. 3 has a structure-imparting unit 1 which is formed by two shaped rollers 2, 3 that are disposed at a spacing from each other and with their axes in parallel relationship. The profiling unit 1 is followed by a calibration unit 9 which in turn is followed by a measuring unit 13 and a severing unit 14, as considered in the direction of transportation movement. The calibration unit 9 is formed by two rollers 10, 11 which are disposed at a spacing from each other with their axes disposed in parallel relationship. The rollers 10, 11 are mounted rotatably. Peripheral surfaces of the rollers 10, 11 define a gap 12.

A strip-shaped metal sheet 6 is unwound from a coil 7 and fed to the structure-imparting unit 1. A structure 8 is imparted to the metal sheet 6 in the structure-imparting unit 1 by the shaped rollers 2, 3. The structure 8 has a height H which is greater than a desired structure height SH. The metal sheet 6, when structured in such a way, is then fed to the calibration unit 9. The metal sheet 6 passes through the gap 12 between the rollers 10, 11. The gap 12 has a height h which is smaller than the height H of the structure 8. While the metal sheet 6 is passing through the calibration unit 9 a force is applied to the structure 8, so that the height of the structure is set to the desired structure height SH. A smooth metal sheet 16 which is unwound from a coil 17 is fed onto the structured sheet 6 upstream of the calibration unit 9. The smooth metal sheet 16 and the structured metal sheet 8 jointly pass through the calibration unit 9.

The calibration unit 9 is followed by the measuring unit 13 with which a spring property of the smooth and the structured metal sheets 6, 16 is ascertained. A blank length L is determined on the basis of the ascertained spring property.

The severing unit 14 following the measuring unit 13 cuts off a portion 18 of the smooth metal sheet 16 and of the structured metal sheet 6. The structured sheets 6 and the smooth sheets 16 are stacked one upon the other, thereby producing a metal sheet pack 19 which can be fitted into a tubular casing, after a twisting operation.

I claim:

1. A process for producing at least one structured metal sheet, which comprises:

providing a strip-shaped metal sheet;

passing the metal sheet between two inter-engaging shaped rollers to form a periodic structure having an initial height and an initial period; and thereafter, calibrating the metal sheet by applying a force to the metal sheet to cause the periodic structure to have a desired height that is less than the initial height and a desired period that is greater than the initial period.

2. The process according to claim 1, wherein the shaped rollers have an overall shaped height greater than the desired structure height.

3. The process according to claim 1, which comprises passing the metal sheet through two meshing shaped rollers during the step of forming the periodic structure.

4. The process according to claim 1, which comprises passing the metal sheet through a gap having a gap height at most equal to the desired structure height of the metal sheet.

5. The process according to claim 4, which comprises forming the gap by two rollers having parallel axes.

6. A process for producing a laminated metal sheet pack, which comprises:

providing a first strip-shaped metal sheet;

passing the first metal sheet between two inter-engaging shaped rollers to form a periodic structure having an initial height and an initial period;

thereafter, calibrating the first metal sheet by applying a force to the first metal sheet to cause the periodic structure to have a desired height that is less than the initial height and a desired period that is greater than the initial period; and placing a second strip-shaped metal sheet onto the first metal sheet.

7. The process according to claim 6, wherein the second strip-shaped metal sheet is a smooth metal sheet.

8. The process according to claim 6, wherein the shaped rollers have an overall shaped profile height greater than the desired structure height.

9. The process according to claim 6, which comprises passing the first metal sheet through a gap having a gap height substantially corresponding to the desired structure height of the first metal sheet.

10. The process according to claim 9, which comprises forming the gap by two rollers with parallel axes.

11. The process according to claim 9, which comprises placing the second metal sheet onto the first metal sheet prior to the calibration step.

12. The process according to claim 6, which comprises placing the second metal sheet onto the first metal sheet after the calibration step.

13. An apparatus for producing structured metal sheets, comprising:

a structure-imparting unit having at least two inter-engaging shaped tools for forming a periodic structure having an initial height and an initial period in a metal sheet moving in a given transport direction; and a calibration unit disposed downstream of said structure-imparting unit in said given transport direction, for applying a force to said structure of the metal sheet causing the periodic structure to have a desired height that is less than the initial height and a desired period that is greater than the initial period.

14. The apparatus according claim 13, wherein said structure-imparting unit has at least two meshing shaped rollers.

15. The apparatus according to claim 13, wherein said shaped tools have a given profile height, said calibration unit has at least two calibration tools for receiving the metal sheet therebetween, and said calibration tools define a gap having a gap height smaller than said given profile height.

16. The apparatus according claim 15, wherein said calibration tools are two rollers with parallel axes.

17. The apparatus according to claim 15, wherein said gap height of said calibration unit is adjustable.

* * * * *